US010188209B2

(12) United States Patent
Hoffmann et al.

(10) Patent No.: US 10,188,209 B2
(45) Date of Patent: Jan. 29, 2019

(54) SECURING DEVICE FOR DETACHABLY SECURING A FRONT PANEL ON A DRAWER

(71) Applicant: Julius Blum GmbH, Hoechst (AT)

(72) Inventors: Benjamin Hoffmann, Dornbirn (AT); Gerald Sperger, Bregenz (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 15/701,989

(22) Filed: Sep. 12, 2017

(65) Prior Publication Data

US 2018/0000242 A1 Jan. 4, 2018

Related U.S. Application Data

(63) Continuation of application No. PCT/AT2016/000025, filed on Mar. 8, 2016.

(30) Foreign Application Priority Data

Mar. 13, 2015 (AT) ..... 50205/2015

(51) Int. Cl.
*A47B 88/956* (2017.01)
*A47B 88/95* (2017.01)

(52) U.S. Cl.
CPC ..... *A47B 88/956* (2017.01); *A47B 88/95* (2017.01); *A47B 2088/954* (2017.01)

(58) Field of Classification Search
CPC ..... A47B 88/956; A47B 2088/954
See application file for complete search history.

(56) References Cited

U.S. PATENT DOCUMENTS

| | | | |
|---|---|---|---|
| 3,666,341 | A | 5/1972 | Little |
| 4,832,420 | A | 5/1989 | Röck et al. |
| 4,846,538 | A | 7/1989 | Röck et al. |
| 4,846,583 | A | 7/1989 | Yamamoto |
| 4,902,080 | A | 2/1990 | Berger |
| 5,540,515 | A | 7/1996 | Röck et al. |
| 8,297,724 | B2 | 10/2012 | Hämmerle |
| 8,801,123 | B2 | 8/2014 | Kueng |

(Continued)

FOREIGN PATENT DOCUMENTS

| | | |
|---|---|---|
| DE | 38 01 103 | 8/1988 |
| EP | 0 740 917 | 11/1996 |

(Continued)

OTHER PUBLICATIONS

International Search Report dated Jun. 14, 2016 in International (PCT) Application No. PCT/AT2016/000025.

*Primary Examiner* — Hanh V Tran
(74) *Attorney, Agent, or Firm* — Wenderoth, Lind & Ponack, L.L.P.

(57) ABSTRACT

A securing device for detachably securing a front panel on a drawer, in particular on a drawer side wall, includes at least one furniture fitting that can be pre-mounted on the front panel, and a catch device assigned to the drawer. During the sliding in of the furniture fitting, the catch device automatically holds the same, and the catch device has a movable catch element. The securing device further includes a locking device that prevents an unintended release of the furniture fitting from the securing device, and the locking device has a movable locking element which is separate from the catch element, and which is positioned on the pre-mountable furniture fitting in a locked position.

23 Claims, 8 Drawing Sheets

(56) References Cited

U.S. PATENT DOCUMENTS

| | | | |
|---|---|---|---|
| 9,033,436 | B2 | 5/2015 | Holzapfel et al. |
| 9,464,652 | B2 | 10/2016 | Holzapfel et al. |
| 2010/0102692 | A1 | 4/2010 | Hämmerle |
| 2013/0249370 | A1 | 9/2013 | Kueng |
| 2014/0072366 | A1 | 3/2014 | Holzapfel et al. |
| 2014/0077677 | A1 | 3/2014 | Holzapfel et al. |

FOREIGN PATENT DOCUMENTS

| | | |
|---|---|---|
| EP | 2 207 456 | 5/2015 |
| WO | 2009/006651 | 1/2009 |
| WO | 2012/068602 | 5/2012 |
| WO | 2012/159139 | 11/2012 |
| WO | 2012/171047 | 12/2012 |

SECURING DEVICE FOR DETACHABLY SECURING A FRONT PANEL ON A DRAWER

BACKGROUND OF THE INVENTION

The present invention concerns a securing device for releasably securing a front panel to a drawer, and a drawer having at least one such securing device and an article of furniture having at least one such drawer.

Securing devices for releasably securing a front panel to a drawer are known in many different designs in the state of the art. EP 0 740 917 B1, for example, discloses a device for securing the front panel of a drawer, wherein the front panel or the fitting thereof can be automatically latched to the drawer frame by a spring-loaded catch member. In the mounted condition of the front panel on the catch member there is provided a locking latch which engages a notch in the catch member. In that case, however, it can always still happen that, upon actuation of the drawer, the front panels perform a slight tilting movement relative to the drawer frame due to the force exerted by the user. That tilting movement upon actuation of the drawer however is undesirable as this substantially results in a delayed movement of the drawer.

WO 2012 159 139 A1 describes, for example, a securing device for releasably securing a front panel to a drawer having a catching device with a moveable catching element which automatically holds the furniture fitting upon insertion of that fitting which is pre-fitted to the front panel and wherein there is provided a locking device for the catching device, which locks the catching element by means of a control element which is moveable in a guide track and which bears against the catching element.

SUMMARY OF THE INVENTION

The object of the invention is to provide a securing device for releasably securing a front panel to a drawer, that is improved over the state of the art.

The fact that the locking device has a moveable locking element which is separate from the catching element and which in a locked position bears against the pre-fitted furniture fitting makes it possible to achieve an optimized configuration for the individual elements. By virtue of the separate configuration of the catching element and the locking element they can be shaped in an optimized fashion for the respective forces occurring, and that can also lead to a reduced size in respect of the respective individual components. By virtue of the fact that the locking element is adapted to be moveable, securing of a furniture fitting which can be pre-fitted to the front panel of a drawer in the securing device can be simplified as the locking element can be adapted to the position of the furniture fitting within the securing device. Because the locking element bears against the pre-fittable furniture fitting in a locked position it can be secured to prevent unintended detachment from the securing device. Pulling the furniture fitting into the securing device and ejecting it from the securing device can also be simplified as the locking element does not impede that movement in a non-locked position. Because the locking element bears against the furniture fitting which can be pre-fitted in a locked position, at least a part of the holding force necessary for securing a front panel to a drawer can also be carried by the locking element.

By virtue of the fact that the locking element in a locked position bears against the pre-fittable furniture fitting with a wedge surface, it is possible to achieve a particularly advantageous shape for the contact surface between the locking element and the pre-fittable furniture fitting. Application of the holding force can also be simplified by virtue of the provision of a wedge surface. The contact involving a wedge surface can also provide that locking of the furniture fitting in the securing device in opposite relationship to the direction of insertion of the furniture fitting in the securing device is achieved, but further insertion of the furniture fitting in the insertion direction is further possible.

The locking element urges the front panel with the pre-fittable furniture fitting in a locked position in spring-loaded relationship towards the drawer the holding force necessary for securing the front panel to the drawer can be applied by the locking element so that the furniture fitting which can be pre-fitted to the front panel is not only held by the securing device but is actively pulled into same. The pre-fittable furniture fitting is urged in spring-loaded relationship towards the drawer, so it is possible in a simple, inexpensive and low-wear fashion to provide a force storage means in the form of at least one spring.

The furniture fitting which can be pre-fitted to the front panel has a transverse pin, and the locking element in a locked position bears against the transverse pin of the furniture fitting. Therefore, it is possible to provide for effective force transmission of the holding force by way of the locking element to the furniture fitting. The fact that the locking element bears against a transverse pin of the furniture fitting means that in a locked position engagement can substantially occur at a point and thus effective locking can be made possible. In addition, the locking element can engage behind the furniture fitting, serving to provide the locking engagement, in a simple fashion.

Because the catching element is mounted pivotably about an axis of rotation (A), it is possible to permit simple guidance for the movement of the catching element. This also allows simple tracking of the catching element upon progressive insertion of the furniture fitting into the securing device or ejection of the furniture fitting from same.

Because the locking element is guided moveably—preferably linearly—in a guide track, it is possible to permit the guide to be of a technically simple shape, which can be achieved using simple means. By virtue of moveable guidance in a guide track the forces which occur and which are necessary for locking of the furniture fitting which can be pre-fitted to a front panel can also be well carried by the securing device. In addition, a preferably linearly extending guide track makes it possible to achieve a short adjustment travel of the locking element from an unlocked position into a locked position or vice-versa.

Because the guide track for the locking element extends transversely relative to the direction of insertion of the furniture fitting which can be pre-fitted to the front panel into the securing device, forces which occur in opposite relationship to the insertion direction can be particularly well carried by the locking element. In that case, the insertion direction can extend along a possible feed track for the furniture fitting. A possible configuration of the guide track for the locking element transversely relative to the direction of insertion of the furniture fitting arises, for example, due to the fact that the guide track for the locking element extends at a right angle to the direction of insertion of the pre-fittable furniture fitting.

The catching element has a pivot lever which is loaded by a force storage means, preferably with at least one spring, and a pull-in lever which is loaded by a force storage means, preferably with at least one spring. The pivot lever pivots the catching element and the pull-in lever pulls the furniture fitting in spring-loaded relationship towards the drawer during the pull-in operation. As a result, a particularly advantageous and integrated configuration for the catching element can be provided. The catch member can be pivoted by the pivot lever the catching element can be pivoted on the one hand upon insertion of the furniture fitting into the securing device by making contact with the furniture fitting and thus the pull-in movement can be triggered. In that case, the pull-in lever of the catching element can act on a part of the furniture fitting and automatically pull same into the securing device in spring-loaded relationship. The spring-loaded configuration of the pivot lever and the pull-in lever those levers—also in conjunction with the furniture fitting—can be held in a given position or can also be urged into a given position. In the pull-in movement, the furniture fitting can be automatically pulled into the securing device by the pull-in lever until the furniture fitting is in a locked position. In that situation, the pivotal lever may possibly also have the responsibility, in the ejection movement of the furniture fitting out of the securing device, of transmitting the force necessary for ejection of the furniture fitting and which can also be provided by a force storage means, to the furniture fitting.

Because the catching element and the separate locking element are motionally coupled—preferably in any position, the positions of the catching element and the separate locking element can be brought into a defined dependency on each other. In that way, the situation may involve a transmission of force, for example also only along a predefined direction in space, between the catching element and the locking element. By virtue of the motional coupling in any position between the catching element and the locking element, the movements thereof can be coupled together during the pulling-in movement, in the locked position, and also during a possible ejection movement.

Because coupling of the movement of the catching element to the movement of the locking element is implemented by an adjusting element secured to the catching element and the adjusting element engages into an opening in the locking element, it is possible to provide for technically simple, direct, low-friction and low-wear motional coupling of the catching element to the locking element. Because the catching element is fixed to the adjusting element, this can permit particularly efficient coupling. Engagement of the adjusting element into an opening in the locking element can provide a motional coupling, for example also in the form of transfer of a rotary movement into a linear movement, in a technically simple fashion.

Because the opening in the locking element is in the form of a curved, straight or stepped slot, it is also possible to achieve a directionally dependent force-locking engagement between the locking element and the catching element. The transmission of the coupling of the movements can also be adjusted in a technically simple fashion in that way.

Because the locking element can be acted upon with a force by the adjusting element from a force storage means acting on the catching element, preferably with at least one spring, it is possible for the movement of the catching element and the movement of the locking element to be supported from a single force storage means. In that way, it can be provided that for example a single spring acts on the locking element and the catching element, whereby this can involve a reduced number of components and reduced manufacturing costs linked thereto for the securing device. In that way, the structural size and thus the space required for the securing device in the drawer can also be reduced.

The securing device has a feed track for the furniture fitting, wherein the feed track is of a substantially straight configuration and wherein the locking device automatically holds the furniture fitting to prevent unintended release thereof, at least two different positions along the feed track. This arrangement can permit easier fitting of the furniture fitting in the securing device, and can thus provide a reduced amount of work in carrying out that operation. A feed track having a straight configuration can permit the securing device to be of a design configuration which can be particularly easily fitted in place. By virtue of the fact that the locking device automatically holds the furniture fitting against unintended detachment at least two different positions along the feed track there are at least two different fitting positions for the securing device within the drawer.

Because the locking device holds the furniture fitting to prevent unintended release thereof, at least region-wise at any positions on the feed track it is possible to particularly easily compensate for manufacturing tolerances in the drawer or the securing device, and various fitting positions of the securing device in the drawer. In addition, securing of the furniture fitting in the securing device can take place without an additional adjustment by a user, whereby it is additionally possible to save on time and costs in the securing procedure.

The securing device has an unlocking device for the locking device, which permits intentional detachment of the furniture fitting from the securing device. The unlocking device lifts the locking element of the furniture fitting and releases the furniture fitting. Therefore, it is possible to permit intentional release of the furniture fitting from the securing device without the securing device being damaged in that case. Because the locking element can be lifted off the furniture fitting by the unlocking device, to release the furniture fitting, the latter is no longer subjected to the holding force and can thus be easily removed from the securing device without being ruined.

The unlocking device has an ejector which permits ejection of the unlocked furniture fitting, and the ejector pivots with the catching element and thereby ejects the furniture fitting from the drawer. Therefore, a dual function can be attributed to the pivot lever, whereby this can permit the provision of a securing device with a reduced number of components and of reduced dimensions.

The unlocking device has a tool receiving means for a tool, which is accessible for the exterior and by way of which the unlocking device and/or the ejector can be actuated. Thus, the risk of injury for a user when actuating the unlocking device can be minimized and this also permits simple quick actuation of the unlocking device.

Because the securing device has a height adjusting device and/or a side adjusting device for the front panel, it is possible to permit height and/or side adjustment of a front panel which can be pre-fitted to the furniture fitting, relative to the drawer frame, and it is thus possible to achieve a particularly preferred and versatile design configuration for the securing device.

A drawer has a drawer frame, a front panel and at least one securing device for releasably securing the front panel to the drawer in accordance with at least one of the described embodiments. Such a drawer is distinguished by particular ease of fitting thereof and by virtue of the compact dimensions of the securing device, due to the particularly small amount of space required for the components forming the drawer.

An article of furniture has at least one described drawer. Such an article of furniture is distinguished by particular ease of fitting and also particularly good utilization of space.

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE INVENTION

Figure 1A:
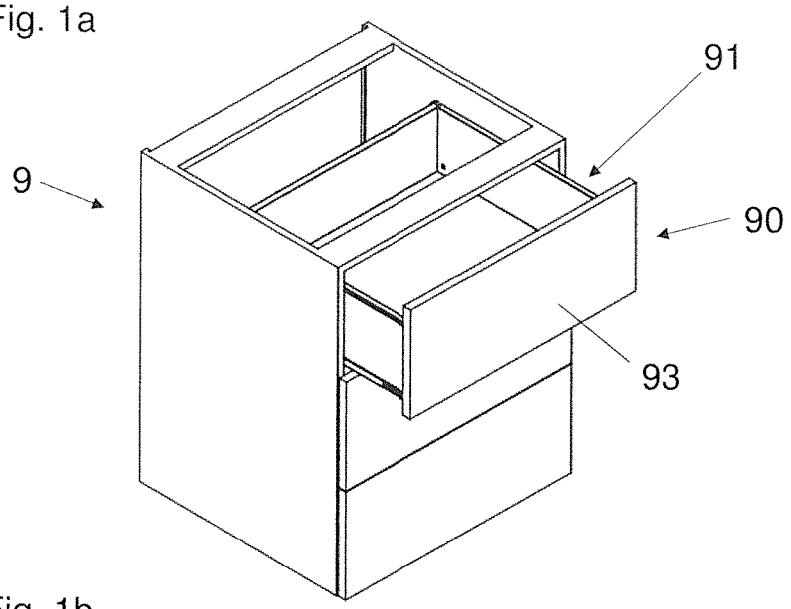
FIG. 1*a* is a perspective view of an article of furniture with drawers.
Figure 1B:
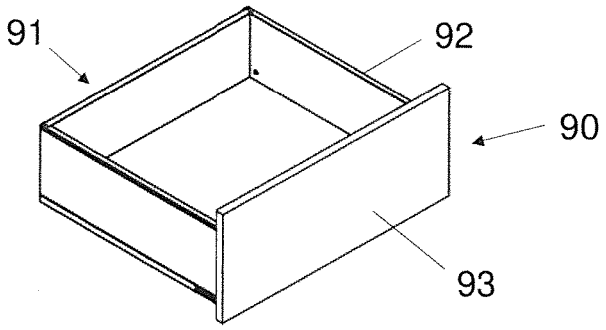
FIG. 1*b* is a perspective view of a drawer.

FIG. 1*a* shows a perspective view of an article of furniture 9 with a partially opened drawer 90. As can be seen from FIG. 1*b*, the drawer 90 in this case has a drawer frame 91 and a front panel 93 fixed to the drawer side walls 92.

Figure 2A:
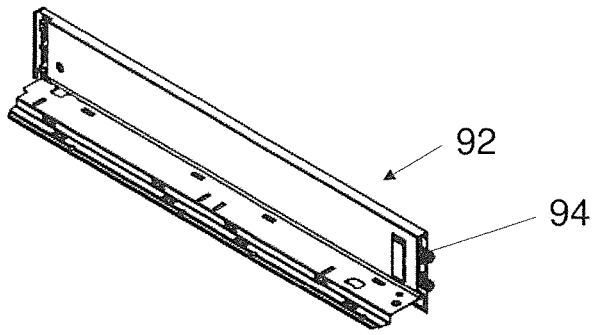
FIG. 2*a* is a perspective view of a side wall of a drawer.
Figure 2B:
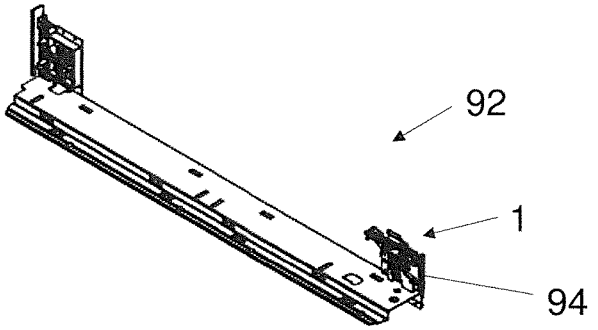
FIG. 2*b* shows a side wall of a drawer with removed facing.

FIG. 2*a* shows a perspective detail view of a drawer side wall 92. In this case the furniture fitting 94 provided for fitting to a front panel 93 (not shown here) projects at the end out of the interior of the drawer side wall 92. FIG. 2*b* shows a perspective view of a drawer side wall 92 with facing removed, whereby the securing device 1 with a furniture fitting 94 secured therein is visible.

Figure 3:
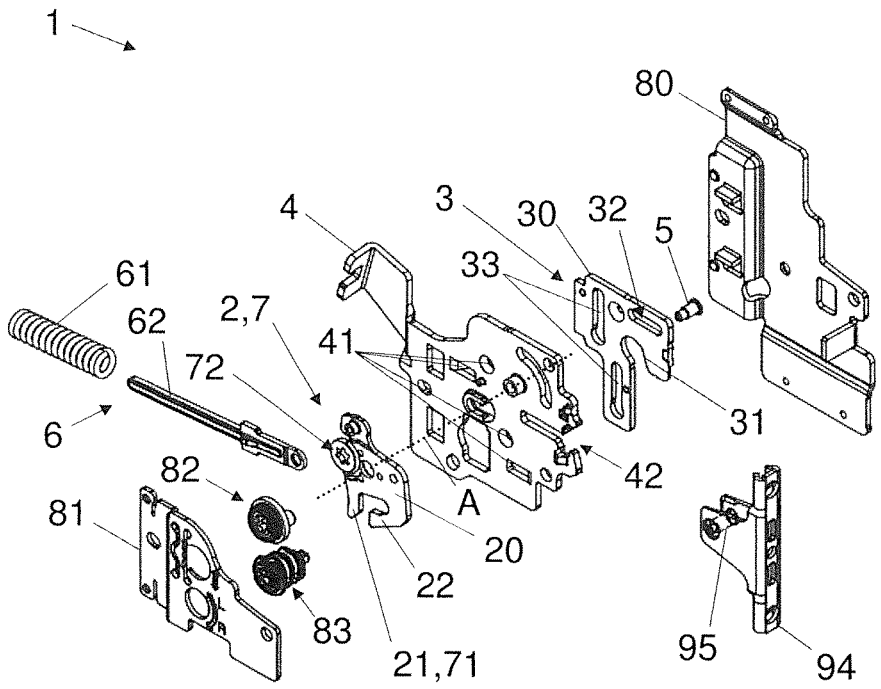
FIG. 3 is a perspective exploded view of a securing device.

FIG. 3 shows a perspective exploded view of a securing device 1 with a furniture fitting 94. The base plate 80 and the holding plate 81 of the securing device 1 can be seen here, which substantially form the housing for the catching device 2 held to the holding plate 4, and the locking device 3. The holding plate 4 holding the above-mentioned devices 2, 3, is secured to the holding plate 81 forming a part of the housing in an assembled condition of the securing device 1 by the height and side adjusting devices 82, 83 which engage into the holding plate 81. In addition, FIG. 3 shows the force storage means 6 which in this embodiment is formed by a spring 61 and a spring guide 62 and which in an assembled condition of the securing device 1 is also mounted to the holding plate 4 and acts on the catching element 20 of the catching device 2. The catching element 20 of the catching device 2 is mounted to the holding plate 4 pivotably about an axis A. The catching element 20 has a pull-in level 21 which serves for the pivotal movement of the catching element 20 and a pull-in lever 22 which serves to pull in the furniture fitting 94 upon pivotal movement of the catching element 20. In this embodiment moreover the unlocking device 7 is functionally provided on the catching element 20 in the form of an ejector 71 which can be operated by way of a tool receiving means 72, wherein the ejector structurally corresponds to the pivot lever 21.

On the side associated with the catching element 20, in this view referred to as the front side, the holding plate 4 has suitable shaped portions for securing the pivotable catching element 20. In addition, a guide track 41 for the locking element 30 of the locking device 3, that is guided at the rear on the holding plate 4, can be provided thereon by suitable embossings in the holding plate 4. Suitable extensions of the guide track 41 on the holding plate 4 can engage in this case into guide slots 33 which in this embodiment extend rectilinearly and perpendicularly, wherein the locking element 30 can at the same time also have finger-shaped projecting portions of the guide track 41 engaging therebehind. The locking element 30 which is guided in that way is motionally coupled to the catching element 20 in a fittable state of the securing device 1 by way of a pin-shaped adjusting element 5 fixedly connected to the catching element 20. In this case the holding plate 4 has a suitably shaped through opening of a configuration which in this embodiment is substantially in the form of a circular arc and which can also serve as an abutment for limiting the pivotal movement of the catching element 20. Provided in the locking element 30 for engagement of the adjusting element 5 which also pivots with the catching element 20 is an opening 32 which in this embodiment is in the form of a slot which extends at a right angle, that is to say horizontally, relative to the perpendicular direction of displacement of the locking element 30. For contacting of the transverse pin 95 of the furniture fitting 94 the locking element 30 has a portion having a wedge surface 31 which engages behind the transverse pin 95 in a locked position of the securing device 1. That wedge surface 31 is of a configuration which falls away in opposite relationship to the insertion direction X (see FIG. 5*a*). The holding plate 4 has a feed track 42 for guiding the insertion movement of the transverse pin 95 of the furniture fitting 94.

Figure 4A:
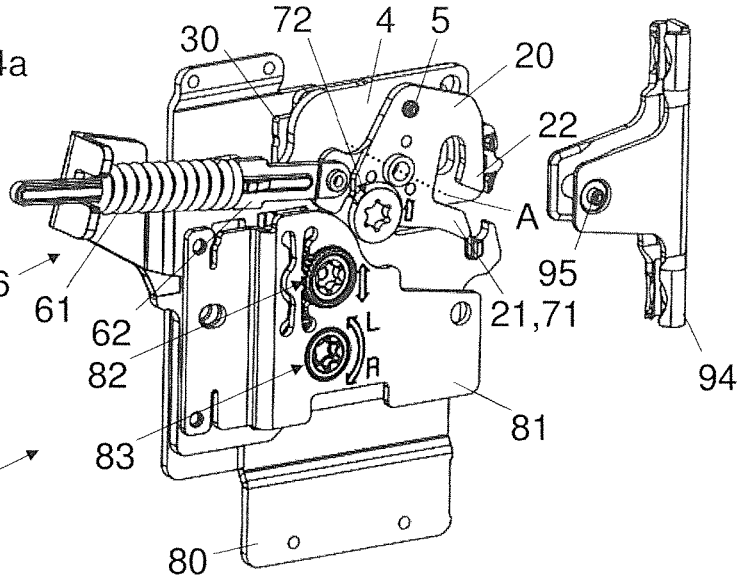
FIG. 4*a* is a perspective side view of the front side of a securing device and a furniture fitting.
Figure 4B:
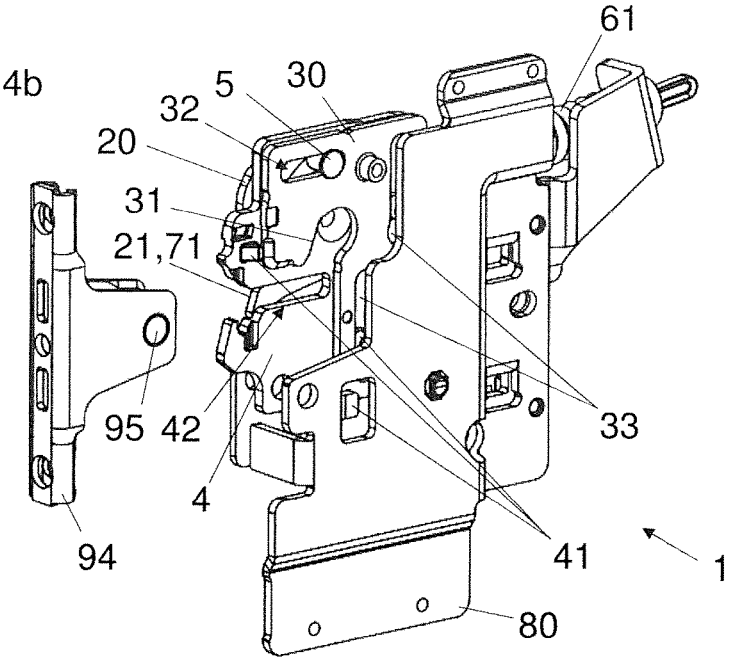
FIG. 4*b* is a perspective side view of a rear side of a securing device and a furniture fitting.

FIG. 4*a* shows a perspective side view of the above-defined front side of an embodiment of the securing device 1. In this case it is firstly possible to see the furniture fitting 94 which can be pre-fitted to a front panel 93 (not shown here), having a transverse pin 95. In addition FIG. 4*a* shows the pivotable catching element 20 with the pivot lever 21, the pulling-in lever 22, the tool receiving means 72 and a part of the adjusting element 5. The position of the catching element 20 corresponds in FIG. 4*a* to an open position or a position with a completely ejected furniture fitting 94. In this case the catching element 20 is subjected to a force applied by the force storage means 6 with the spring 61 by way of the spring guide 62. In that respect the line of action of that force extends in the view in FIG. 4*a* below the axis of rotation A, therefore the catching element 20 is held in an open position. The locking element 30 is disposed in that position of the securing device 1, as can also be seen from FIG. 4*a*, in a position substantially corresponding to the upper end position along the guide track 41. In the rear view of the securing device 1 shown in FIG. 4*b* it is possible to see the shaped portions constituting the guide track 41 for the locking element 30 and in part the engagement thereof into the guide slots 33 of the locking element 30. The locking element 30 is thereby guided in a guide track 41 which has a linear configuration and is secured against movement in or in opposite relationship to the insertion direction X (see FIG. 5*a*). In this open position of the securing device 1, the locking element 30 with the wedge surface 31 also does not have any region which overlaps with the feed track 42 for the transverse pin 95.

Figure 5A:
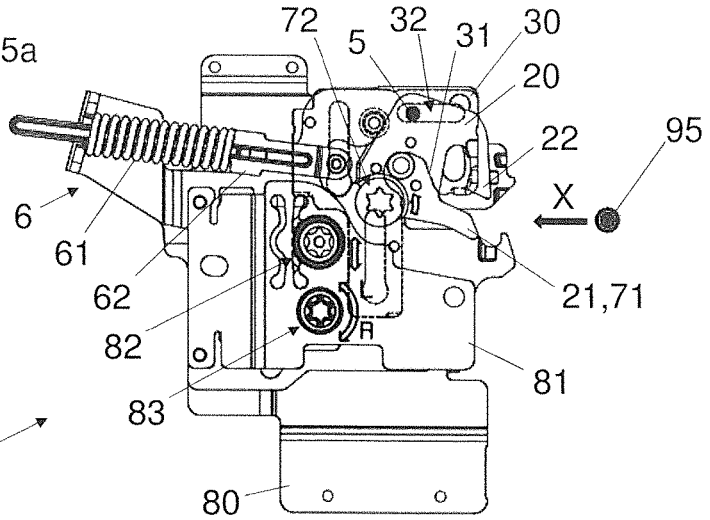
FIGS. 5*a* through 8*b* are a side views of the securing device in various stages during insertion, displacement and locking of a furniture fitting.

FIG. 5*a* shows a side view of the open position of the securing device 1, that is already shown in FIG. 4*a*, wherein only the transverse pin 95 of the furniture fitting 94 is shown here and hereinafter for improved visibility. The locking element 30 or the catching element 20 is shown transparently in FIG. 5*a* and the following Figures depending on the respective front or rear view in order to clearly show the cooperation of the elements 20, 30. The insertion direction X, that substantially coincides with the configuration of the guide track 41, of the transverse pin 95 of the furniture fitting 94 (which is not completely shown here) is respectively indicated by an arrow.

Figure 6A:
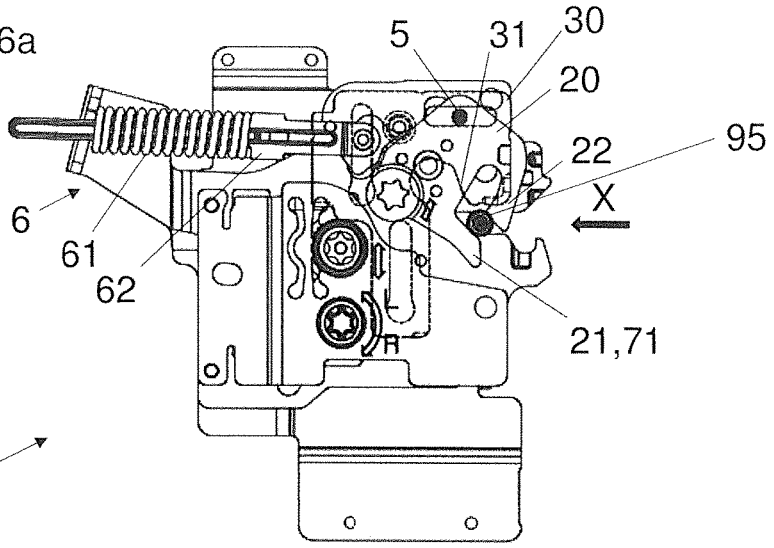
Figure 6B:
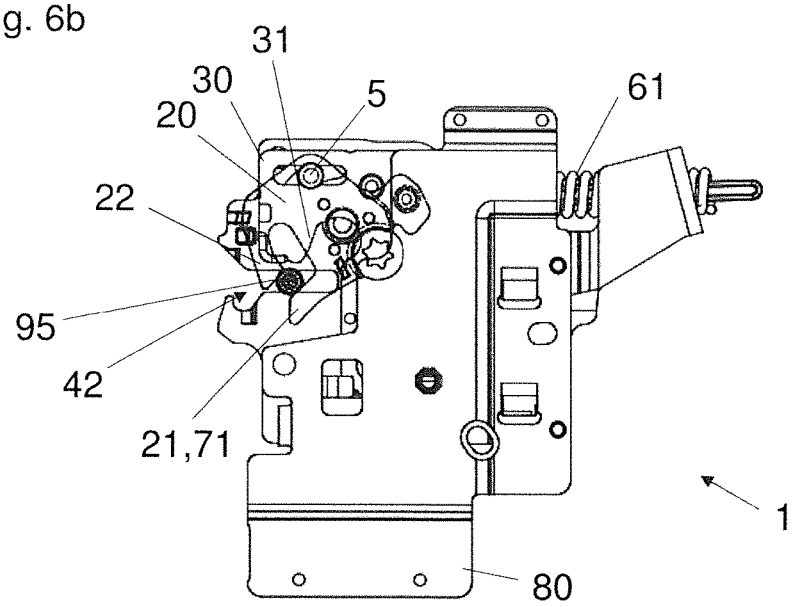

FIG. 6*a* shows a securing device 1 with a transverse pin 95 partially inserted into the feed track 42. The catching element 20 is pivoted by the force on the pivot lever 21, that acts in the insertion direction X and that is initially applied by a user upon fitting of the furniture fitting 94 (not shown here) which can be pre-fitted to a front panel 93, and in that case, as shown here, the line of action of the spring force applied by the force storage means 6 on the catching element 20 is moved over the axis of rotation A (see FIG. 4*a*), that is to say the assembly moves beyond the dead point of the catching device 2. When the dead point of the catching device 2 is overcome in the pivotal movement of the catching element 20 the automatic operation of pulling the transverse pin 95 into the securing device 1 is initiated. By virtue of the fact that the transverse pin 95 bears on the feed track 42 on the holding plate 4 the transverse pin 95 can be conveyed in spring-loaded relationship along the feed track 42 into the securing device by virtue of a pivotal movement of the pulling-in lever 22. By engagement of the adjusting element 5 which also pivots with the catching element 20 in the opening 32 in the locking element 30, in which case the adjusting element 5 can move relative to the locking element 30 along the opening 32 which is in the form of a horizontal slot, the pivotal movement of the catching element 20 is transferred to a linear movement of the locking element 30, which in this embodiment is perpendicular. As can also be seen from the rear view shown in FIG. 6*b* of that position of the securing device 1 the locking element 30 is moved a distance along the guide track 41 in the direction of a locked position by way of the motional coupling with the partially pivoted catching element 20. Further insertion movement but also removal of the transverse pin 95 without having to actuate the unlocking device 7 is still possible in that position of the securing device 1.

Figure 7A:
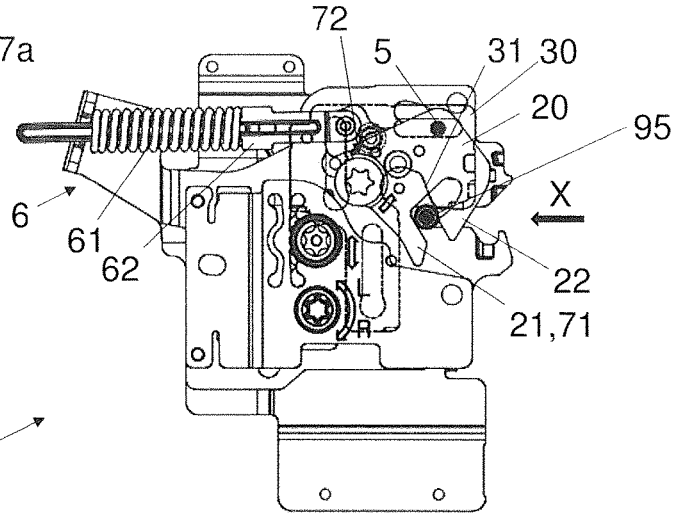
Figure 7B:
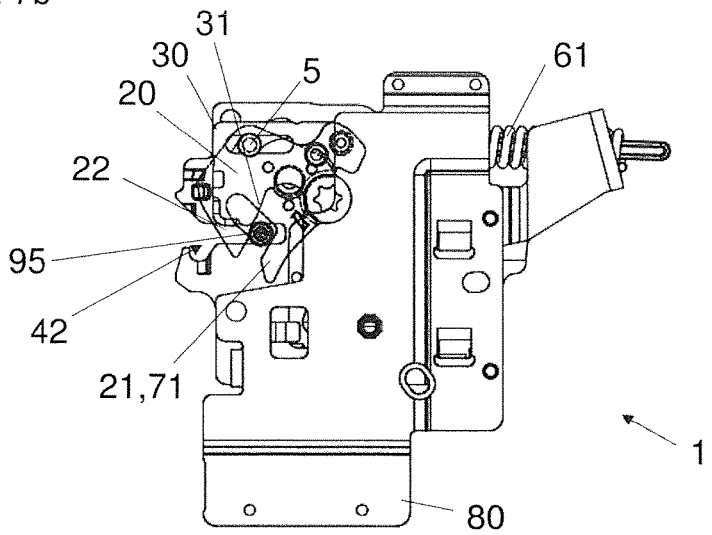

FIG. 7*a* shows a position of the securing device 1, in which the transverse pin 95 has been pulled further along the feed track 42 into the securing device 1 by the spring-loaded pulling-in lever 22. In this case the catching element 20 is pivoted to such an extent that the pulling-in lever 22 still bears against the transverse pin 95 and the locking element 30 was also transported by way of the motional coupling to such an extent that it bears with the wedge surface 31 against the transverse pin 95. Without the locking element 30 by actuation of the unlocking device 7, which substantially corresponds to a pivotal movement of the ejector 71 in opposite relationship to the insertion direction X and linked thereto lifting of the locking element 30, the transverse pin 95 can no longer be removed by a simple pulling movement in opposite relationship to the insertion direction X, from the securing device 1. FIGS. 7*a* and 7*b* thus show a locked position of the securing device 1. As viewed in the insertion direction X that locked position corresponds to an outermost position within a region in which the transverse pin 95 and thus the furniture fitting 94 (which is not shown completely here) is held against unintended release, along the feed track 42. As can be seen from FIG. 7*b* the transverse pin 95 in that outermost locked position of the securing device 1 is still a certain distance away from the end of the feed track 42, and therefore further insertion of the transverse pin 95 along the insertion direction X is still possible.

Figure 8A:
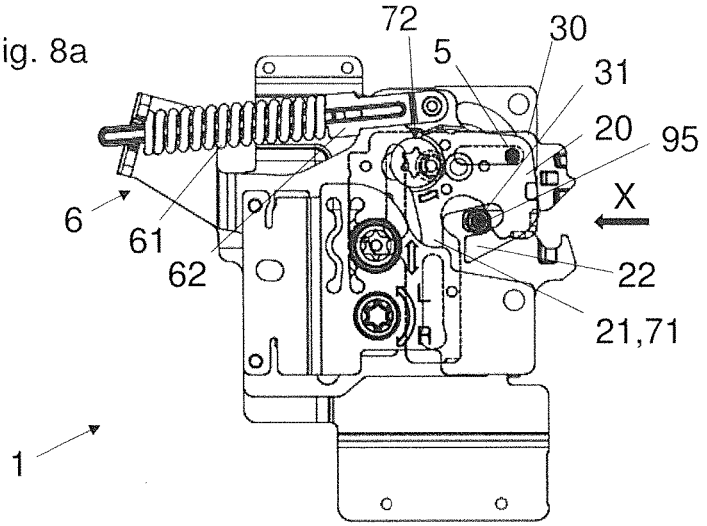

FIG. 8*a* shows a securing device 1 with a transverse pin 95 introduced therein along the feed track 42, in a locked position. In this case, in comparison with the preceding Figures, the catching element 20 is further pivoted, wherein by virtue of the motional coupling to the locking element 30 by way of the adjusting element 5 which is also pivoted with the catching element 20 and the engagement thereof in the opening 32 in the locking element 30 same was displaced along the guide track 41 further downwardly, that is to say in the direction of the transverse pin 95. In this locked position the locking element 30 bears with a wedge surface 31 against the transverse pin 95. The configuration of the wedge surface 31, that rises as viewed in the insertion direction, and the spring force actuation of the force storage means 6 on the catching element 20, that is transmitted by way of the adjusting element 5 to the locking element 30, provides that the transverse pin 95 is further urged along the guide track 41 in the insertion direction X into the securing device 1. A static situation in respect of the moveable parts can occur if for example a front panel 93 (not shown here) which can be connected to the securing device 1 by way of the furniture fitting 94 (which is not shown completely here) bears in butting relationship at the end against the drawer side wall 92 (not shown) in which the securing device 1 is disposed and can be fitted. In an already locked position in an outer region of the feed track 42, as shown for example in FIGS. 7*a* and 7*b*, the last part of the pulling-in movement can be actively assisted by the shape of the locking element 30 with the wedge surface 31. If in a locked position a pulling force is exerted in opposite relationship to the insertion direction X on the transverse pin 95, for example by virtue of an opening movement which is transmitted by way of the front panel 93 (not shown) to the securing device 1, of a drawer 90 which is also not shown here, by a user, then the transverse pin 95, due to locking by the locking element 30, cannot be moved along the feed track 42 in opposite relationship to the insertion direction X. In that case a force acting in opposite relationship to the insertion direction X on the transverse pin 95 would be transmitted to the wedge surface 31, in which case the part, occurring transversely relative to the guide track 41, of the resulting force acting on the locking element 30, in the illustrated embodiment being the horizontal component, is carried by the holding plate 4 and thus as a consequence by the securing device 1 which in the mounted position is fixedly connected to the drawer frame 91. The component, acting on the locking element 30 in the direction of the guide track 41, of the resulting force, in the embodiment illustrated here being the vertical component, turns out to be very slight due to the configuration of the contact surface between the transverse pin 95 and the locking element 30 in the form of the wedge surface 31. That force is in opposition to the force which is applied by the force storage means 6 and which is transmitted by way of the adjusting element 5 to the locking element 30, as well as the frictional forces which occur and which are additionally to be overcome. That can finally involve frictional locking of the transverse pin 95 in the securing device 1. The force occurring when a pull is applied to the transverse pin 95 in opposite relationship to the insertion direction X, on the pulling-in lever 22, by virtue of the shaping of the pulling-in lever, by which scarcely any moment is produced on the catching element 20—insofar as the pulling-in lever 22 still bears against the transverse pin 95 in a locked position—can also not result in unintended release of the furniture fitting 94 from the securing device 1.

Figure 5B:
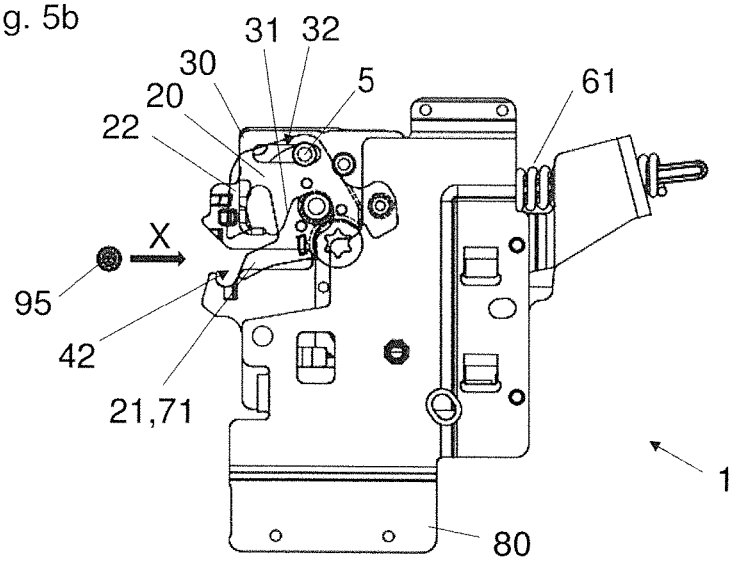
Figure 8B:
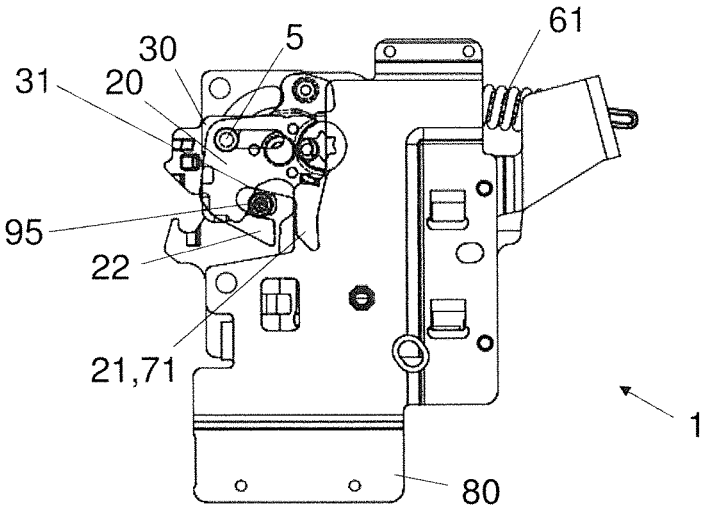

Considered in the reverse sequence, FIGS. 8*b* to 5*a* show ejection of the transverse pin 95 from the securing device 1 by actuation of the unlocking device 7. If the catching element 20 is pivoted in opposite relationship to the insertion direction in a locked position as shown in FIG. 8*a* or 8*b*, with a tool engaging by way of the tool receiving means 72, whereby the motional coupling of the catching element 20 to the locking element 30 also causes the latter to be lifted off the transverse pin 95, with the ejector 71 being moved in the direction of the transverse pin 95. As shown in FIGS. 7*a* and 7*b* the ejector 71 can bear against the transverse pin 95 and upon further pivotal movement of the catching element 20 and linked thereto further lifting of the locking element 30 it can displace the transverse pin 95 along the feed track 42 in opposite relationship to the insertion direction X. Finally, by further pivotal movement of the catching element 20 in opposite relationship to the insertion direction, as shown for example in FIGS. 6*a* and 6*b*, the transverse pin 95 can be still further transported out along the feed track 42 and, as shown in FIGS. 5*a* and 5*b*, can be removed therefrom.

The invention claimed is:

1. A securing device for releasably securing a front panel to a drawer, comprising:

a furniture fitting to be pre-fitted to the front panel;

a catching device to be connected to the drawer, the catching device configured such that, upon insertion of the furniture fitting, the catching device automatically holds the furniture fitting, and the catching device having a moveable catching element, and a locking device configured to prevent unintentional release of the furniture fitting from the securing device, wherein the locking device has a moveable locking element separate from the catching element and configured to bear against the pre-fittable furniture fitting in a locked position, the catching element and the separate locking element being motionally coupled, and wherein the securing device further comprises an adjusting element fixed to the catching element to couple the motion of the catching element to the motion of the locking element, the adjusting element engaging into an opening in the locking element.

2. The securing device as set forth in claim 1, wherein the locking element is configured to bear with a wedge surface against the pre-fittable furniture fitting in a locked position.

3. The securing device as set forth in claim 1, wherein the locking element is configured to urge the front panel with the pre-fittable furniture fitting in a locked position in spring-loaded relationship towards the drawer.

4. The securing device as set forth in claim 1, wherein the furniture fitting to be pre-fitted to the furniture panel has a transverse pin, and the locking element in a locked position bears against the transverse pin of the furniture fitting.

5. The securing device as set forth in claim 1, wherein the catching element is mounted pivotably about an axis of rotation.

6. The securing device as set forth in claim 1, wherein the locking element is guided moveably in a guide track.

7. The securing device as set forth in claim 6, wherein the guide track for the locking element extends transversely relative to the insertion direction of the furniture fitting to be pre-fitted to the front panel into the securing device.

8. The securing device as set forth in claim 1, wherein the catching element has a pivot lever to be loaded by a force storage member and a pulling-in lever to be loaded by a force storage member, wherein the pivot lever is configured to pivot the catching element and the pulling-in lever pulls the furniture fitting in a spring-loaded relationship towards the drawer during the pulling-in process.

9. The securing device as set forth in claim 1, wherein the catching element and the separate locking element are motionally coupled in any position.

10. The securing device as set forth in claim 1, wherein the opening in the locking element is in the form of a curved, straight or stepped slot.

11. The securing device as set forth in claim 9, wherein the locking element is subjected to a force by the adjusting element from a force storage member acting on the catching element.

12. The securing device as set forth in claim 1, wherein the securing device has an unlocking device for the locking device configured to permit intentional release of the furniture fitting from the securing device, the unlocking device being configured to lift the locking element off the furniture fitting and release the furniture fitting.

13. The securing device as set forth in claim 12, wherein the unlocking device has an ejector configured to permit ejection of the unlocked furniture fitting, the ejector being configured to pivot with the catching element to thereby eject the furniture fitting from the drawer.

14. The securing device as set forth in claim 12, wherein the unlocking device has a tool receiving member for receiving a tool, the tool receiving member being accessible from the exterior and being configured to actuate at least one of the unlocking device and the ejector.

15. The securing device as set forth in claim 1, wherein the securing device further comprises a height adjusting device for adjusting a height of the front panel.

16. A drawer comprising: a drawer frame, a front panel and the securing device for releasably securing the front panel to the drawer as set forth in claim 1.

17. An article of furniture comprising a drawer as set forth in claim 16.

18. The securing device as set forth in claim 6, wherein the locking element is guided linearly in the guide track.

19. The securing device as set forth in claim 8, wherein the force storage member for loading the pivot lever comprises a spring, and the force storage member for loading the pulling-in lever comprises a spring.

20. The securing device as set forth in claim 11, wherein the force storage member acting on the catching element comprises a spring.

21. The securing device as set forth in claim 1, wherein the securing device further comprises a side adjusting device for adjusting a side of the front panel.

22. A securing device for releasably securing a front panel to a drawer, comprising:

a furniture fitting to be pre-fitted to the front panel;

a catching device to be connected to the drawer, the catching device configured such that, upon insertion of the furniture fitting, the catching device automatically holds the furniture fitting, and the catching device having a moveable catching element, and a locking device configured to prevent unintentional release of the furniture fitting from the securing device, wherein the locking device has a moveable locking element separate from the catching element and configured to bear against the pre-fittable furniture fitting in a locked position, and wherein the securing device further comprises a feed track for the furniture fitting, the feed track having a substantially straight configuration, the locking device being configured to automatically hold the furniture fitting against unintentional release at least two different positions along the feed track.

23. The securing device as set forth in claim 22, wherein the locking device is configured to hold the furniture fitting against unintentional release at least region-wise at any position on the guide track.

* * * * *